United States Patent [19]

Matsuura et al.

[11] Patent Number: 4,796,576

[45] Date of Patent: Jan. 10, 1989

[54] ADJUSTMENT MECHANISM FOR CERAMIC ROCKER ARM

[75] Inventors: Tooru Matsuura; Noboru Ishida; Mitsuyoshi Kawamura, all of Aichi, Japan

[73] Assignee: NGK Spark Plug Co., Ltd., Aichi, Japan

[21] Appl. No.: 65,880

[22] Filed: Jun. 24, 1987

[30] Foreign Application Priority Data

Jun. 30, 1986 [JP] Japan ..... 61-98988[U]

[51] Int. Cl.[4] ..... F01L 1/18

[52] U.S. Cl. ..... 123/90.43; 123/90.44

[58] Field of Search ..... 123/90.43, 90.44, 90.45; 74/559, 569

[56] References Cited

U.S. PATENT DOCUMENTS 1,710,291 4/1929 Brush ..... 123/90.43
4,598,675 7/1986 Long ..... 123/90.51
4,658,770 4/1987 Okuyama et al. ..... 123/90.43

FOREIGN PATENT DOCUMENTS 515985 8/1955 Canada ..... 123/90.45
769874 3/1957 United Kingdom ..... 123/90.45

*Primary Examiner*—Andrew M. Dolinar
*Attorney, Agent, or Firm*—Finnegan, Henderson, Farabow, Garrett & Dunner

[57] ABSTRACT

An adjustment mechanism for a ceramic rocker arm. The ceramic rocker arm is formed with a smooth bored opening through the adjustment end of the rocker arm. An externally threaded adjusting shaft is passed through the opening and an internally threaded locking member such as a locking nut is disposed on the shaft and engaged on the external threads. An internally threaded member is disposed to engage the external threads of the shaft and also engage the adjustment end of the rocker arm.

9 Claims, 2 Drawing Sheets

ADJUSTMENT MECHANISM FOR CERAMIC ROCKER ARM

BACKGROUND OF THE INVENTION

1. Field of the Invention

The present invention relates to improvements in rocker arms for internal combustion engines.

2. Description of the Prior Art

The increased demand for internal combustion engines capable of generating higher power while still affording easy maintenance has provided incentive to use advanced materials in the valve train of such engines. One of the efforts in improving the valve train is to employ new materials such as ceramics to make the valve train lighter in weight and more durable. In overhead cam configurations where the cam slides on a portion of the rocker arm, die cast aluminum rocker arms are used with a sintered metal alloy portion cast in place at the location interfacing with the cam. In such a manner, the rocker arm is wear resistant, highly rigid, lightweight and of sufficient strength. In addition, ceramic inserts are increasingly being used in such rocker arms to improve their wear resistant properties during high speed operation because conventional metal inserts used in diesel and LPG engines wear rapidly in such applications.

There have also been attempts to form rocker arms from ceramic materials by monolithic molding to provide a lightweight rigid and wear resistant rocker arm. See, Japanese Application No. 47188/86 by the present applicant.

When such a rocker arm is provided with an adjustment screw or lash adjustment for providing the appropriate valve clearance, it is necessary to bore a hole through the adjustment end of the rocker arm and form internal threads therein. When such a rocker arm is formed of a ceramic, the threads formed prior to sintering are distorted by dimensional changes occurring during the sintering process. In addition, if the threads are mechanically formed after sintering, the processes for forming such threads are relatively difficult because of the high hardness of the sintered ceramic.

Therefore, it is one object of the present invention to provide a valve adjustment mechanism on a ceramic rocker arm that can be inexpensively manufactured.

It is another object of the invention to provide a valve adjustment mechanism for a ceramic rocker arm which can be readily interfaced to the ceramic portion of the rocker arm without expensive forming techniques.

Additional objects and advantages of the invention will be set forth in the description which follows and in part will be obvious from the description or may be learned by practice of the invention. The object and advantages of the invention may be realized and obtained by means of the instrumentalities and combinations particularly pointed out in the appended claims.

SUMMARY OF THE INVENTION

To achieve the foregoing objects in accordance with the purposes of the invention as embodied and broadly described herein, an adjustment mechanism for a ceramic rocker arm is provided where the rocker arm has a valve engaging end and an opposite adjustment end. The valve mechanism comprises an opening through the adjustment end of the rocker arm, with the opening having an unthreaded bore. An internally threaded adjusting shaft is disposed to pass through the opening and an internally threaded locking member on the shaft is disposed to engage the internal threads of the adjusting shaft. An internally threaded member is disposed to engage the external threads of the shaft with the internally threaded member being engaged on the adjustment end of the rocker arm.

BRIEF DESCRIPTION OF THE DRAWINGS

The accompanying drawings, which are incorporated in and constitute a part of the specification, illustrate preferred embodiments of the invention and together with the general description above and the detailed description of the preferred embodiments given below serve to explain the principles of the invention.

DESCRIPTION OF THE PREFERRED EMBODIMENTS

Reference will now be made in detail to the present preferred embodiments of the invention as illustrated in the accompanying drawings.

Figure 1:
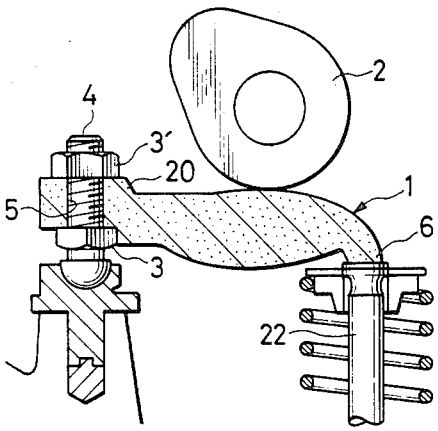
FIG. 1 is a schematic cross section of the valve train of an internal combustion engine illustrating one embodiment of the present invention.

As here embodied and depicted in FIG. 1, there is provided a rocker arm 1 made of ceramic material by a monolithic molding that includes an opening 5 in an adjustment end 20 of the ceramic rocker arm 1 opposite a valve actuating end 6 of the rocker arm. The valve actuating end 6 is disposed opposite a valve stem 22. The opening 5 has an unthreaded bore that receives an externally threaded shaft 4 that is used to adjust the valve clearance in the internal combustion engine. In this embodiment, there is included a nut 3 disposed on the shaft 4 to provide an adjustment member for moving the shaft with respect to the rocker arm and the cam 2 thereby adjusting the valve clearance in the internal combustion engine. Also included on the shaft 5 in this embodiment is a locking nut 3'. By changing the position of nuts 3 and 3' on shaft 4, the clearance at valve actuating end 6 with the valve stem 22 can be selectively adjusted.

Figure 2:
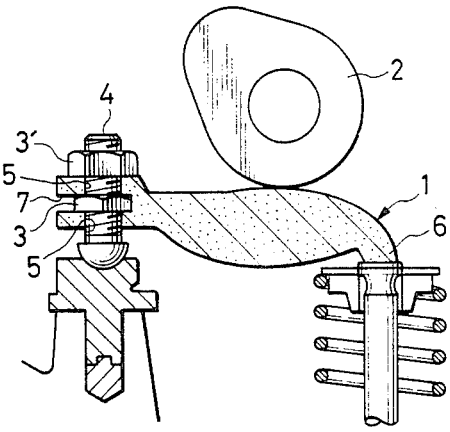
FIG. 2 is a cross section similar to that of FIG. 1 showing a second embodiment of the invention.

In the embodiment of FIG. 2, the adjustment end 20 of the rocker arm is U shaped and includes a nut receiving slot 7 disposed to receive and engage a nut 3 in a position that is coaxial with the unthreaded bore of opening 5 through adjustment end 20 of the rocker arm. In such a manner, the adjustment end of rocker arm 1 engages shaft 4 and adjustment of shaft 4 with respect to rocker arm 1 can be made by turning the shaft 4 with respect to the nut 3 and locking them in the adjusted configuration by turning the nut 3'.

Figure 3A:
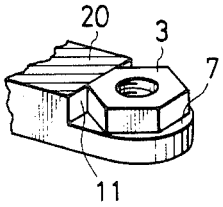
FIGS. 3(A)–(E) illustrate a number of embodiments using a nut-like metal insert engaged on the adjustment end of the rocker arm.
Figure 3B:
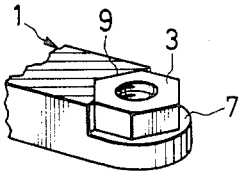
Figure 3C:
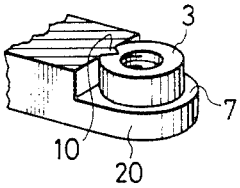
Figure 3D:
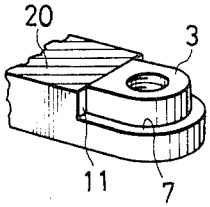
Figure 3E:
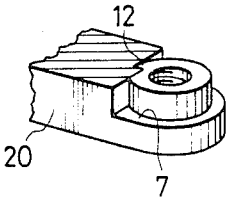

FIGS. 3(A) through 3(E) show various configurations of nut receiving slot 7 and nut 3 that can be engaged on adjustment end 20 of rocker arm 1. By engaging the nut or nut-like metal insert depicted in the embodiments of FIG. 3, rotation of the nut in response to vibration of the rocker arm is eliminated. FIG. 3(B) depicts an embodiment where nut 3 is engaged by a notch portion 9 of slot 7 as opposed to a flat portion 11 as shown in FIG. 3(A), that prevents rotation of nut 3. The embodiment of FIG. 3(D) also uses a flat portion 11 with a nut-like member 3. The embodiments of FIGS. 3(C) and (E) use nut-like members 3 having a notch therein that engages a projection 10 and 12, respectively, in nut receiving slot 7.

Figure 4A:
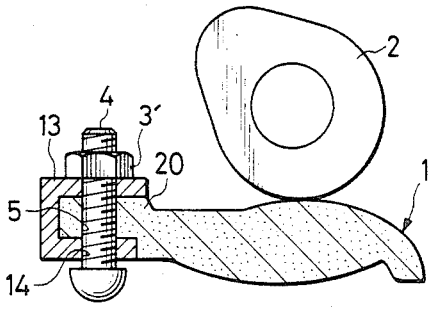
FIGS. 4(A) and (B) show another embodiment of the invention using a U-shaped metal insert.
Figure 4B:
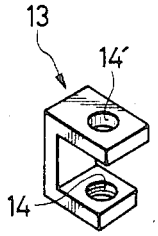
Figure 5A:
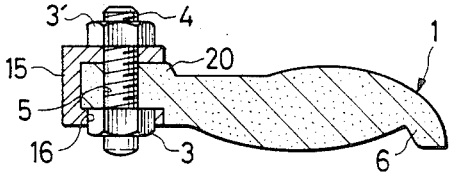
FIGS. 5(A) and (B) shows another embodiment of the present invention using a U-shaped metal insert that forms the internal threaded member on the adjustment end of the rocker arm.
Figure 5B:
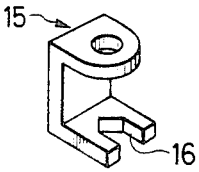

As embodied in FIGS. 4 and 5, there are shown two additional configurations of an internally threaded member that engages adjustment end 20 of rocker arm 1 with externally threaded adjusting shaft 4 disposed in opening 5 of rocker arm 1. In the embodiment of FIGS. 4(A) and (B), there is provided a U-shaped member 13 having a threaded opening 14 on one side with a coaxial smooth bore opening 14' on the other side. U-shaped member 13 is engaged on adjustment end 20 of the rocker arm 1 as depicted in FIG. 4(A).

FIG. 5 shows a variation of the embodiment of FIG. 4 where instead of a threaded opening 14 there is provided a nut engaging opening 16. The nut engaging opening grasps the nut 3 and prevents it from rotating with respect to a U-shaped member 15. This prevents the nut 3 from moving with respect to rocker arm 1 and falling off shaft 4 when shaft 4 is turned to adjust the valves. In the embodiments of FIGS. 4 and 5, the U-shaped metal member is less rigid and is adapted to conform to adjustment end 20 of ceramic rocker arm 1 as the nut 3' on the shaft 4 is tightened.

Figure 6:
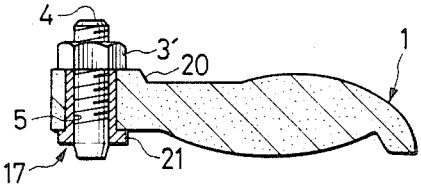
FIG. 6 shows a cross section of another embodiment of the invention using a stepped sleeve.

In the embodiment of FIG. 6, the ceramic rocker arm is provided with a stepped sleeve 17 disposed to fit within the unthreaded bore of opening 5 through adjustment end 20 of rocker arm 1. The stepped sleeve includes shoulders 21 disposed to engage the bottom surface of the rocker arm to prevent vertical movement of the stepped sleeve 17 and thus the externally threaded adjustment shaft 4 disposed within the stepped sleeve. The nut 3' disposed on the shaft 4 is used to lock the shaft 4 and the sleeve 17 with respect to the rocker arm 1.

Figure 7A:
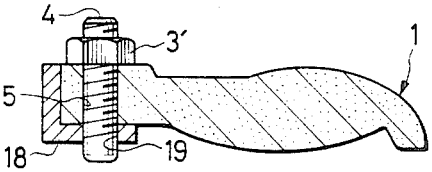
FIGS. 7(A) and (B) shows another embodiment of the invention using an L-shaped metal member.
Figure 7B:
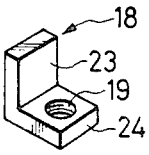

In the embodiment of FIG. 7, there is provided an L-shaped member 18 having one flange 23 and the second flange 24 with a threaded opening 19 therein. The threaded opening 19 engages the external threads on the adjustment shaft 4 and the flange 23 prevents the L-shaped metal member 18 from moving with respect to the adjustment end 20 of the rocker arm 1. The nut 3' locks the threaded shaft 4 in the appropriately adjusted position.

In all the embodiments of the present invention, the externally threaded adjustment shaft is turned to move the shaft up and down with respect to the rocker arm in the opening in the adjustment end of the rocker arm. By moving the shaft vertically up and down, this adjusts the valve clearance for the engine in which the rocker arm is used.

In the embodiment described, the wear resistance, rigidity and light weight of the ceramic rocker arm are effectively utilized in the valve train mechanism of an internal combustion engine while still allowing provision for the adjustment of valve clearance without expensive forming techniques to make an intricate adjustment mechanism in the rocker arm. Additional advantages of the invention and modifications thereof will occur to those skilled in the art. The invention has been disclosed in terms of preferred embodiments but the scope of the invention is not limited thereto. The scope of the invention is defined by the appended claims and their equivalents.

What is claimed is:

1. An adjustment mechanism for a ceramic rocker arm, said rocker arm having a valve engaging end and an opposite adjustment end, said mechanism comprising:

an opening through said adjustment end of said rocker arm, said opening having an unthreaded circular bore;

an externally threaded adjusting shaft disposed to pass through said opening;

an internally threaded locking member on said shaft disposed to engage the external threads of said adjusting shaft; and an internally threaded member having a threaded portion disposed to engage the external threads of said shaft, said threaded member being engaged on said adjustment end of said rocker arm.

2. The adjustment mechanism of claim 1 wherein said internally threaded member comprises a U-shaped metal member disposed to fit over said adjustment end of said rocker arm, said U-shaped metal member having two coaxial openings therethrough, one of said openings being internally threaded to comprise the threaded portion of said internally threaded member.

3. The adjustment mechanism of claim 1 wherein said internally threaded member comprises a U-shaped metal member, disposed to fit over the adjustment end of said rocker arm, and an internally threaded nut, said U-shaped member including means for engaging said nut to restrict movement of said nut relative to said U-shaped member.

4. The adjustment mechanism of claim 1 wherein said internally threaded member comprises a stepped metal sleeve, having internal threads and an external surface configured to fit within said opening, said stepped portion of said sleeve being configured to engage said adjustment end of said rocker arm.

5. The adjustment mechanism of claim 1 wherein said internally threaded member comprises an L-shaped metal member having a first flange disposed to engage said adjustment end of said rocker arm and a second flange having a threaded opening disposed to comprise the threaded portion of said internally threaded member.

6. The adjustment mechanism of claim 1 wherein said internally threaded member comprises a nut-like member disposed to engage said shaft and said adjustment end of said rocker arm, said adjustment end of said rocker arm having means for preventing rotation of said nut-like member.

7. The adjustment mechanism of claim 1 wherein said internally threaded member comprises a nut, said adjustment end of said rocker arm further including a nut-receiving slot disposed to receive and engage said nut in a position coaxial with said unthreaded bore of said opening through said adjustment end of said rocker arm.

8. The adjustment mechanism of claim 1 wherein said internally threaded locking member and said internally threaded member combine with said adjusting shaft to compress a portion of the adjustment end of said rocker arm.

9. An adjustment mechanism for a ceramic rocker arm, said rocker arm having a valve engaging end and an opposite adjustment end, said mechanism comprising:

an opening through said adjustment end of said rocker arm, said opening having an unthreaded bore;

a nut-receiving slot included in the adjustment end of said rocker arm, said slot being disposed to receive and engage a nut in a position coaxial with said unthreaded bore of said opening through said adjustment end of said rocker arm;

an externally threaded adjusting shaft disposed to pass through said opening;

an internally threaded locking member on said shaft disposed to engage the external threads of said adjusting shaft; and an internally threaded nut-like member having a threaded portion disposed to engage the external threads of said shaft, said nut-like member being disposed within said nut-receiving slot.

* * * * *